US006176053B1

(12) United States Patent
St. Germain

(10) Patent No.: US 6,176,053 B1
(45) Date of Patent: Jan. 23, 2001

(54) WALL TRACK ASSEMBLY AND METHOD FOR INSTALLING THE SAME

(75) Inventor: Roger C. A. St. Germain, 22 Boomfield Rd., Burlingame, CA (US) 94010

(73) Assignee: Roger C. A. St. Germain, San Francisco, CA (US)

( * ) Notice: Under 35 U.S.C. 154(b), the term of this patent shall be extended for 0 days.

(21) Appl. No.: 09/384,000

(22) Filed: Aug. 26, 1999

Related U.S. Application Data

(60) Provisional application No. 60/098,076, filed on Aug. 27, 1998, provisional application No. 60/104,010, filed on Oct. 13, 1998, and provisional application No. 60/105,833, filed on Oct. 27, 1998.

(51) Int. Cl.[7] ..... E04C 2/00
(52) U.S. Cl. ..... 52/232; 52/281; 52/481.1
(58) Field of Search ..... 52/232, 241, 281, 52/479, 481.1

(56) References Cited

U.S. PATENT DOCUMENTS

| | | | | |
|---|---|---|---|---|
| 3,271,920 | * | 9/1966 | Downing, Jr. | 52/481.1 X |
| 3,324,617 | * | 6/1967 | Knight et al. | 52/481.1 |
| 3,333,390 | * | 8/1967 | Banning | 52/481.1 X |
| 3,533,205 | * | 10/1970 | Pestel et al. | 52/481.1 X |
| 3,839,839 | * | 10/1974 | Tillisch et al. | 52/481.1 X |
| 4,283,892 | | 8/1981 | Brown . | |
| 4,364,212 | * | 12/1982 | Pearson et al. | 52/481.1 X |
| 4,866,899 | * | 9/1989 | Houser | 52/481.1 |
| 5,127,203 | | 7/1992 | Paquette . | |
| 5,127,760 | | 7/1992 | Brady . | |
| 5,222,335 | | 6/1993 | Petrecca . | |
| 5,287,675 | * | 2/1994 | McGee | 52/281 X |
| 5,394,665 | * | 3/1995 | Johnson | 52/481.1 X |
| 5,471,805 | | 12/1995 | Becker . | |
| 5,546,711 | * | 8/1996 | Heller | 52/232 X |
| 5,724,784 | | 3/1998 | Menchetti . | |
| 5,740,644 | * | 4/1998 | Menchetti | 52/281 |
| 5,755,066 | | 5/1998 | Becker . | |
| 5,797,233 | | 8/1998 | Hascall . | |
| 5,913,788 | * | 6/1999 | Herren | 52/481.1 X |
| 6,058,668 | * | 5/2000 | Herren | 52/481.1 X |

OTHER PUBLICATIONS

Sliptrack Systems, Inc. Product Literature, The Donovan Company, Inc., 1998, Tom Donovan (29 pages).
Metal–Lite, Inc. Slotted Top Track Product Literature, Thompson and La Brie, Structural Engineers, Aug. 29, 1996 (20 pages).
Fire Trak Corp. Product Literature, 1996 (31 pages).
*Fire Resistance Design Manual*, 15$^{th}$ ed., Gypsum Association, 1997 (126 pages).

* cited by examiner

*Primary Examiner*—Bruce A. Lev
(74) *Attorney, Agent, or Firm*—Karin E. Peterka

(57) ABSTRACT

A cap track assembly for use with a fire resistant wall structure where the cap track assembly is adapted for attachment to a top structural member and to a plurality of wall studs. The apparatus is also directed to a method for installing the cap track assembly into a fire resistant wall structure. In one version, the apparatus provides a track assembly comprising a U-shaped longitudinal metal track having angled lips depending outwardly from the bottom ends of each of the side walls of the track, and an end tab and top tabs having longitudinal openings and depending downwardly at an angle of about 90 degrees from a top wall of the track. The track assembly further comprises a fire resistant material extending along the outer side walls of the track and supported on the lip of each of the side walls. During deflection, the cap track assembly allows for vertical movement of the studs and gypsum wallboards within the track, while also maintaining positive attachment of the track assembly to the top structural member. The apparatus is also directed to a track assembly for use with a fire resistant shaft wall such as an elevator shaft, a track assembly for use with an inclined top structural member, and a track assembly for use with a curved wall structure.

25 Claims, 13 Drawing Sheets

WALL TRACK ASSEMBLY AND METHOD FOR INSTALLING THE SAME

CROSS-REFERENCE TO RELATED APPLICATIONS

This application is a continuation-in-part of U.S. provisional patent application Ser. No. 60/098,076, filed Aug. 27, 1998, titled "Cycle Cap Track For Fire Rated Cyclical Gypsum Wall Assemblies", currently pending; U.S. provisional patent application Ser. No. 60/104,010, filed Oct. 13, 1998, titled "Shaft Wall Cycle Top Track", currently pending; and, U.S. provisional patent application Ser. No. 60/105,833, filed Oct. 27, 1998, titled "Incline Cycle Cap Track For Fire Rated Cyclical Gypsum Wall Assemblies", currently pending.

BACKGROUND OF THE INVENTION

The present invention is directed to a wall track assembly and method for installing the same. More particularly, the present invention is directed to a unique cap track assembly and method for installing the same into a cyclical design fire resistant wall structure.

Conventional fire resistant wall assemblies typically comprise a track assembly, metal studs, and gypsum wallboards, i.e., drywall, all installed between a floor and an overhead structure. The studs are retained in the track assembly by suitable securing means. Vertically oriented studs are typically mounted in a spaced relationship to provide a support structure onto which the gypsum wallboards or other wall surface materials can be installed. The studs often include lateral bores through which electrical, plumbing, or other conduits can also be mounted. The studs and gypsum wallboards are spaced from the overhead structure in order to allow for settling or other movement of the overhead structure with respect to the wall assembly. Typically, a fireproofing material or firesafing material is applied adjacent the track in the space between the gypsum wallboard and the overhead structure.

An important concern among builders, architects, and those in the construction industry is compliance with building codes relating to fire resistant or fire rated wall construction, as well as compliance with building codes relating to seismic movement, such as earthquakes. Building codes typically require fireproof ratings of one hour, two hours, or some other time period for walls and connections between walls and an overhead structure, such as a deck or roof. There are typically two categories of tests for fire rated walls—the static fire test and the cyclical fire test. The static fire test provides test panels with movement in design, but the panels are not cycled before fire testing. However, they are tested in an open position in the fire chamber. With static condition fire rated wall assemblies, when deflection occurs, such as during an earthquake, the studs move vertically upwardly and downwardly within the track and there is a gap between the top of the studs and the overhead structure for the fire caulking or fireproofing material. The problem with static condition fire rated wall assemblies is that when deflection occurs, the fire caulking and gypsum boards can be easily crushed. Many building codes, especially those in earthquake zones, are now requiring that fire rated wall assemblies be of a cyclical condition, that is, that they pass the cyclical fire test. The cyclical fire test requires the test panels to be cycled, and then the same panel fire tested in an open position. The test criteria adopted by the International Conference of Building Officials (ICBO) for the cyclical method is 500 cycles prior to submitting the panel to fire, that is, the gypsum boards or entire wall assembly must move vertically upwardly and downwardly 500 times with approximately a 1 inch deflection.

Building codes, especially in earthquake zones, also require a load test for fire rated walls. Building movement is a factor in substantially vertical connections made between the studs and such conventional structural elements as interior walls, exterior walls, and floor assemblies. Building movement can negatively effect vertical seams between consecutive sheets of gypsum wallboards and can crack firesafing material such as caulking.

Known cyclical condition fire rated wall assemblies include a two track assembly or a one track assembly. The two track assembly utilizes a first track along the overhead structure and a second track within the first track. The one track assembly utilizes a single track along the overhead structure and supersedes the two track assembly because the one track assembly is simpler and less expensive, and unlike the two track assembly, the one track assembly provides positive attachment of the wall assembly to the overhead structure. Thus, one track assemblies have been found to be advantageous and are commonly used.

Known one track assemblies for use with fire resistant and seismic resistant cyclical design wall structures are disclosed in U.S. Pat. No. 5,127,203 and U.S. Pat. No. 5,127,760. These patents both disclose a fire resistant and seismic wall structure having a cyclical design slotted track which allows for both upward and downward movement of the structure without adversely affecting positive attachment of the framing members. As shown in FIG. 1 (prior art), the known cyclical design slotted track includes a U-shaped track 2 with a plurality of vertical slots 4 along the sides of the track, and the track 2 is attached to a stud 6. However, there are problems associated with the use of these slotted tracks. For example, such slotted tracks require the installation of shims on the tracks so that any overlapping layers of gypsum wallboards that are installed will be able to move against the shim during deflection in the cyclical condition to maintain the fire rating. For purposes of this application, a "shim" is defined as a piece of metal or other material used to fill out space, for example, for leveling or deflection. After the track assembly and any other wall attachments, such as electrical wiring, plumbing, and the like, are installed, the gypsum wallboards are installed. The installation of the gypsum wallboards with these known track assemblies requires the installation of shims as well. It is difficult to install the shims after the track and other wall attachments have been installed or mounted because of the difficulty in seeing where to install the shims and the difficulty in maneuvering around the other wall mountings to install the shims. This increases the overall time for installing the gypsum wallboards and increases the overall labor and construction costs. In addition, another problem with these known track assemblies is that when the gypsum wallboards are installed, the tops of the gypsum wallboards must be cut into a fluted configuration or another configuration in order for them to fit properly into the overhead structure. Having to specially cut the top of the gypsum wallboard is also difficult, time consuming, and increases the overall labor and construction costs. Finally, another problem with these known track assemblies is that the gypsum wallboards are installed along the outer sides of the track and during deflection move vertically upwardly and downwardly against the outside of the gypsum wallboard on the studs rather than within the track. Problems with this configuration occur because when the gypsum wallboard is installed or deflects vertically upwardly, the gypsum wallboard hits or rubs against any overlapping gypsum wallboard. The attachment means is raised above the surface of the track. Thus, upon deflection, the gypsum wallboard is forced over the raised attachment means and creates unnecessary friction or damage to the gypsum wallboard causing it to deteriorate, resulting in possible loss or failure of fire rating.

Another known cyclical design one track assembly for use with fire resistant and seismic resistant wall structures is disclosed in U.S. Pat. No. 5,471,805. Although this track assembly does not have slots and does not require the use of shims, it does require the use of clips for reinforcing the stud to track connection while allowing for deflection. This known cyclical design track includes a U-shaped track having a clip for attachment of the stud to the track. The problems associated with installing shims, as discussed above, are also associated with installing such clips, and the installation of such clips can be difficult, time consuming, and increase the overall labor and construction costs. In addition, this known track assembly also requires that when the gypsum wallboard is installed, the top of the gypsum wallboard must be cut into a fluted configuration or another configuration in order for it to fit properly into the overhead structure. Having to specially cut the gypsum wallboard is difficult, time consuming, and increases the overall labor and construction costs.

Accordingly, there is a need for a cyclical design one track assembly that can be more easily installed at a lower cost and that provides improved performance and durability. In particular, there is a need for a cyclical design one track assembly that does not require the use of shims or clips and thus decreases installation, labor and overall construction costs; that does not require that when the gypsum wallboards are installed, that the top of the gypsum wallboards be specially cut into a fluted configuration or another configuration so that the gypsum wallboards fit properly into the overhead structure and thus decreases installation, labor, and overall construction costs; that avoids damaging the gypsum wallboards during vertical deflection associated with known track assemblies where the gypsum wallboards deflect along the outer sides of the track rather then within the track itself; and, that allows the gypsum wallboard to be easily inserted and move vertically upwardly and downwardly within the track thereby protecting it during deflection.

SUMMARY OF THE INVENTION

The present invention satisfies these needs as well as provides a unique and advantageous cyclical design cap track assembly and method for installing the same. The present invention has the advantages that it decreases gypsum wallboard installation costs and labor costs by as much as 50%; that it is simple to install and easy to use; that it is durable and long lasting; that it provides a bottom lip on each outer side of the track for supporting and holding applied fireproofing material in place during deflection, such as during an earthquake; that it satisfies the cyclical condition building code requirements; that it provides a unique cap design for receiving the gypsum wallboards and studs within the track during deflection; that it provides a unique tab system including a tab at one end of the track and a plurality of tabs on the top of the track where the tabs have longitudinal openings for insertion of attachment means to attach the studs to the track thereby allowing the studs to move vertically upwardly and downwardly within the track during deflection; and that uses a fireproofing material to provide a fire and smoke seal, thus decreasing installation costs and overall construction costs.

The invention is directed to a track assembly for use with a fire resistant wall structure where the track assembly is adapted for attachment to a top structural member and to a plurality of wall studs. The invention is also directed to a method for installing the track assembly of the present invention into a fire resistant wall structure.

In one version, the present invention provides a track assembly comprising: a longitudinal track having, (i) a first end and a second end; (ii) a top wall, and first and second opposed side walls each depending downwardly from and generally perpendicular to the top wall, each side wall having a top end and a bottom end, and the top wall and side walls defining a substantially U-shaped configuration; (iii) an angled lip depending outwardly from the bottom end of each of the side walls; (iv) an end tab at the first end of the track where the end tab depends downwardly from the top wall of the track; (v) a plurality of top tabs spaced an equal distance apart along the top wall of the track, each top tab depending downwardly from the top wall of the track; (vi) a plurality of longitudinal openings formed within the end tab and top tabs. The track assembly further comprises a plurality of first attachment means passing through the top wall of the track and into the top structural member for securing the top wall of the track to the top structural member. The track assembly further comprises a plurality of second attachment means passing through the longitudinal openings of the end tab and top tabs and into the studs for securing the end tab and top tabs of the track to the studs, while also allowing vertical movement of the studs with respect to the longitudinal openings of the tabs. The track assembly further comprises a fire resistant material extending along the outer side walls of the track and supported on the lip of each of the side walls. During deflection, the track assembly of the present invention is adapted to slidably receive within the track the studs and a plurality of gypsum wallboards adjacent to the studs, while also maintaining positive attachment of the track assembly to the top structural member.

In another version of the present invention, the track assembly is used with a fire resistant shaft wall structure, such as an elevator shaft. For a two-hour fire rated wall assembly, the end tab and top tabs on the longitudinal track are not centered between the side walls of the track but are off center to compensate for the smaller width of the back layer of gypsum wallboard installed along the back side of the stud and the larger width of the two front layers of gypsum wallboard installed along the front side of the stud. For a one-hour fire rated wall assembly, the end tab and top tabs on the longitudinal track are also not centered between the side walls of the track but are off center to compensate for the larger width of the back layer of gypsum wallboard installed along the back side of the stud and the smaller width of the front layer of gypsum wallboard installed along the front side of the stud.

In another version of the present invention, the track assembly is used with a fire resistant wall structure, and the track assembly is adapted for attachment to an inclined top structural member or inclined overhead structure, such as a roof. With this version of the invention, the spacing of the end tab and top tabs along the track is designed to correspond to the layout of the studs along a bottom floor structure. In addition, the angle of the bend of the end tab and top tabs in the track is about 90 degrees to the bottom floor structure regardless of the degree of incline of the overhead structure.

In another version of the present invention, the track assembly is adapted for use with a curved or radiused fire resistant wall, such as a C-shaped or S-shaped wall. With this version of the invention, the positioning of separately attached tabs along the track is determined by the length of the radius of the curve of the wall. In addition, the angle of the bend of the tabs along the track is about 90 degrees to a bottom floor structure.

The present invention is also directed to a method of installing the track assembly of the present invention into a fire resistant wall structure. The method is directed to installing a track assembly in a cyclical design fire resistant wall structure comprising: providing the track assembly according to the present invention; mounting the top wall of the track assembly to a top structural member via a first attachment means; positioning a plurality of vertically extending studs between a bottom structural member and the top structural member wherein the upper portions of the studs are in alignment with the end tab and top tabs of the track and wherein the upper portions of the studs are positioned within the track; attaching the studs to the end tab and top tabs of the track with a second attachment means by passing the second attachment means through the longitudinal openings of the end tab and top tabs and into the studs so as to allow vertical movement upwardly and downwardly along the longitudinal openings; and installing a plurality of gypsum wallboards on each side of the studs so that the tops of the gypsum wallboards are within the track and move vertically upwardly and downwardly within the track upon deflection.

BRIEF DESCRIPTION OF THE DRAWINGS

These and other features, aspects and advantages of the present invention will become better understood from the following description, appended claims and accompanying drawings, where:

DETAILED DESCRIPTION

Figure 1:
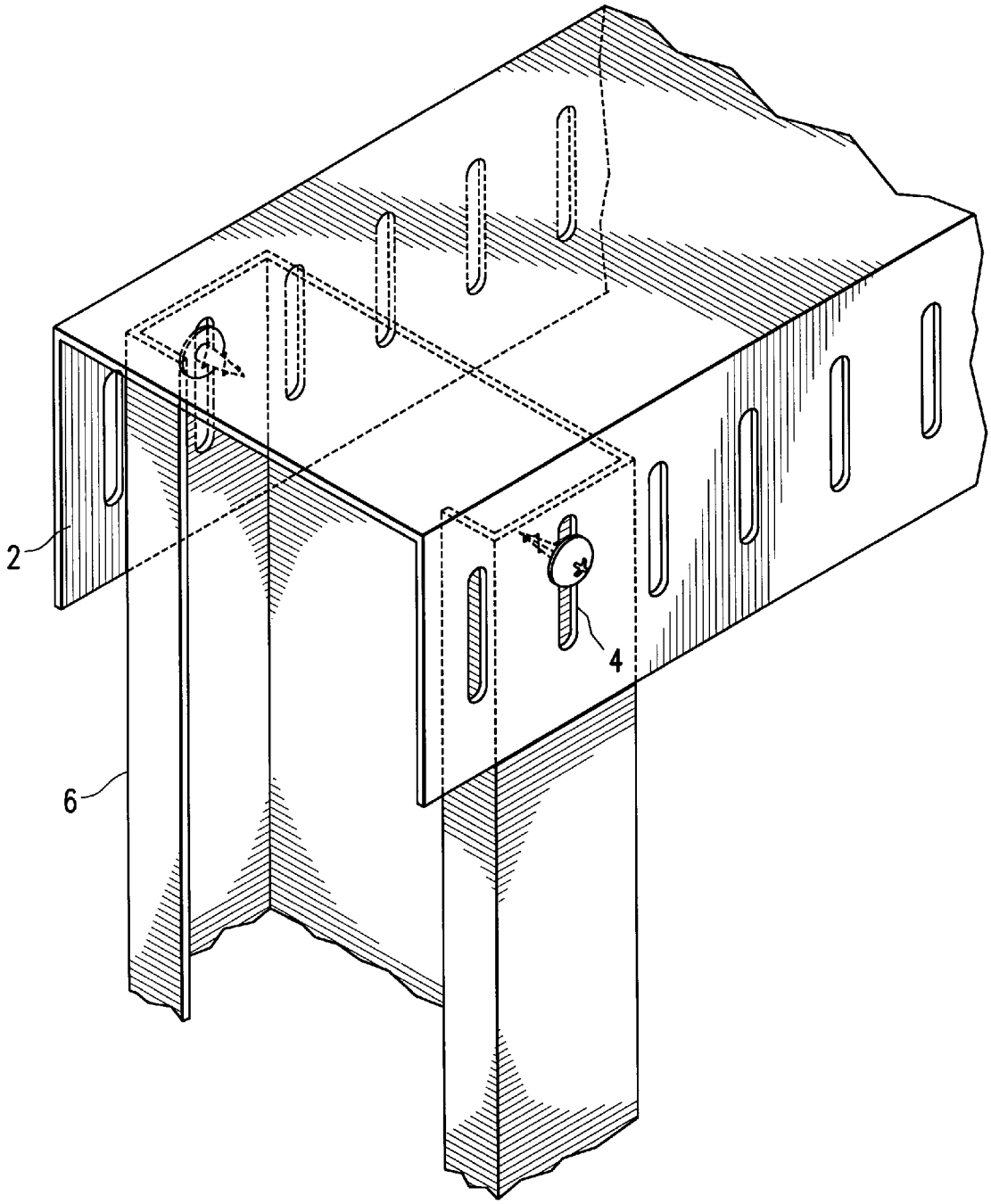
FIG. 1 PRIOR ART
FIG. 1 is a perspective view of a prior art one track assembly.

The present invention is directed to a unique cap track assembly and method for installing the same into a cyclical design fire resistant wall structure. FIG. 1 is a perspective view of a prior art one track assembly, as discussed above. As shown in FIG. 1, the known cyclical design slotted track includes a U-shaped track 2 with a plurality of vertical slots 4 along the sides of the track, and the track 2 is attached to a stud 6.

Figure 2:
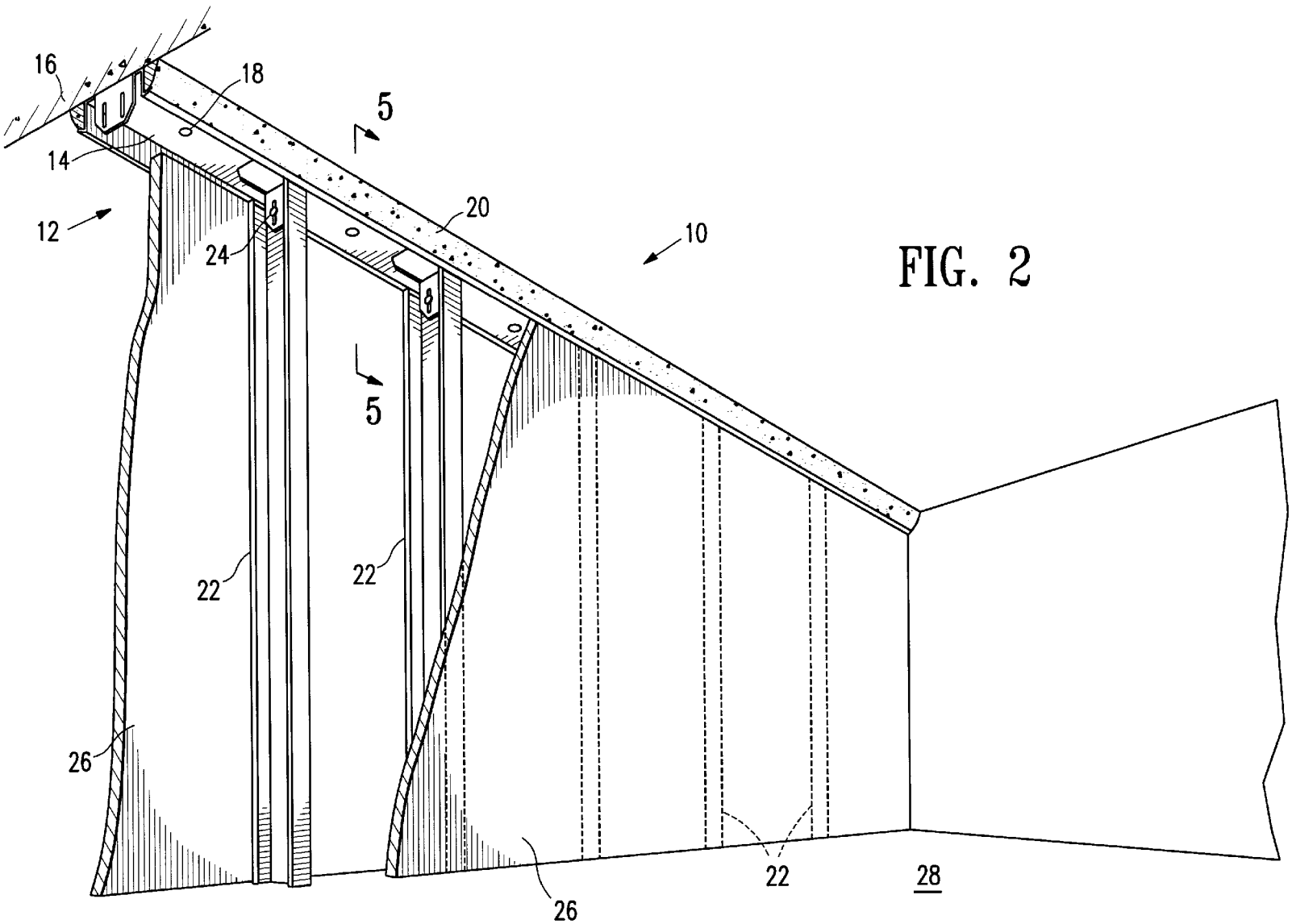
FIG. 2 is a perspective view of a first version of the track assembly of the present invention.

FIGS. 2–7 show a first preferred version of the present invention. FIG. 2 is a perspective environmental view of a fire resistant wall structure 10 including a track assembly 12 according to the present invention. The track assembly 12 includes a longitudinal track 14. The track 14 is preferably comprised of metal such as galvanized steel. The track 14 is preferably manufactured by a metal stud manufacturer or a sheet metal fabrication manufacturer and may be obtained from Cimco of Industry, California. Preferably, the track 14 is cut into 8 foot long or 10 foot long pieces. However, other suitable lengths of track may also be used depending on the wall construction. The thickness of the steel used to make the track is preferably 16 gauge, 18 gauge, 20 gauge, or another suitable thickness. Typically, 20 gauge steel is used to make a track for use with interior non-load bearing walls, and typically, 16 gauge steel is used to make a track for use with exterior load bearing walls. The track 14 is preferably attached to a top structural member 16. The top structural member 16 may comprise an overhead structure such as a ceiling, deck, or roof, and may be comprised of concrete, metal, wood, a combination thereof, or another suitable material. The track 14 is attached to the top structural member 16 via a plurality of first attachment means 18. The first attachment means 18 may comprise conventional concrete nails, screws, nuts and bolts, concrete wedge anchors, welding means, or another suitable attachment means. Preferably, the first attachment means 18 comprises concrete nails having a length in the range of about ¾ inch to about 1 inch.

The track assembly 12 further comprises a fireproofing material 20. The fireproofing material 20 is preferably spray applied between the track 14 and the top structural member 16 so that the fireproofing material is adjacent the exterior length of the track 14 and adjacent the bottom of the top structural member 16. Preferably, the fireproofing material is installed after the track 14 is installed. It is preferable to apply the fireproofing material with as few structures, i.e., plumbing, electrical wiring, installed into the wall structure as possible so as to decrease the costs of applying the fireproofing material. Preferably, a layer of fireproofing material in the range of about 1½ inches thick to about 2 inches thick is applied along the length of the exterior of the track 14 and along the bottom of the top structural member 16. Preferably, the fireproofing material is a lightweight gypsum-aggregate plaster, Type MK-6/HY, which is available from W. R. Grace & Co. of Cambridge, Mass., MSDS # Z-01457000001. The preferred fireproofing material is a single component, mill-mixed fireproofing plaster which requires only the addition of water on the job site to form a consistent, pumpable slurry, and which is designed for use on structural steel columns, beams, joints, trusses, and floor and roof decking. The fireproofing material used with the present invention provides significant advantages such as proven in-place performance, low in-place cost, fast and efficient application, Underwriters Laboratory tested and factory inspected, and universal building code compliance. Other suitable fireproofing materials may also be used with the present invention. Fireproofing materials rather than firesafing materials are preferred because of the decreased cost and superior properties provided.

The wall structure 10 further comprises a plurality of vertical studs 22. Preferably, the studs 22 are comprised of metal such as galvanized steel and may preferably be C-shaped, U-shaped, or CH-shaped in configuration and cross-section. For example, the C-shaped stud is typically defined by a top wall, lateral side walls depending from each side of the top wall, and a pair of inwardly-directed return flanges at the edges of the lateral side walls in order to provide structural integrity. The studs 22 may be obtained from Cimco of Industry, California. The studs 22 are attached to the track 14 via a plurality of second attachment means 24. Preferably, the second attachment means 24 comprise conventional screws inserted with a screw gun. Preferably, the screws are wafer pan head screws having a length of about ½ inch. However, other suitable second attachment means may also be used with the present invention.

The wall structure 10 further comprises a plurality of gypsum wallboards 26. The gypsum wallboards 26 may comprise drywall. Typically, the gypsum wallboards have a thickness of ⅝ inch and are cut into 4 feet by 8 feet sheets. The gypsum wallboards may be obtained from United States Gypsum Company of Chicago, Ill. The bottom of the gypsum wallboards 26 and the bottom of the studs 22 are preferably attached to a floor member 28 with conventional screws. Preferably, in use, the track assembly 12, studs 22, and gypsum wallboards 26 are installed between the top structural member 16 and the floor member 28. Preferably, the gypsum wallboards are attached to the studs with a plurality of attachment means such as screws.

Figure 3:
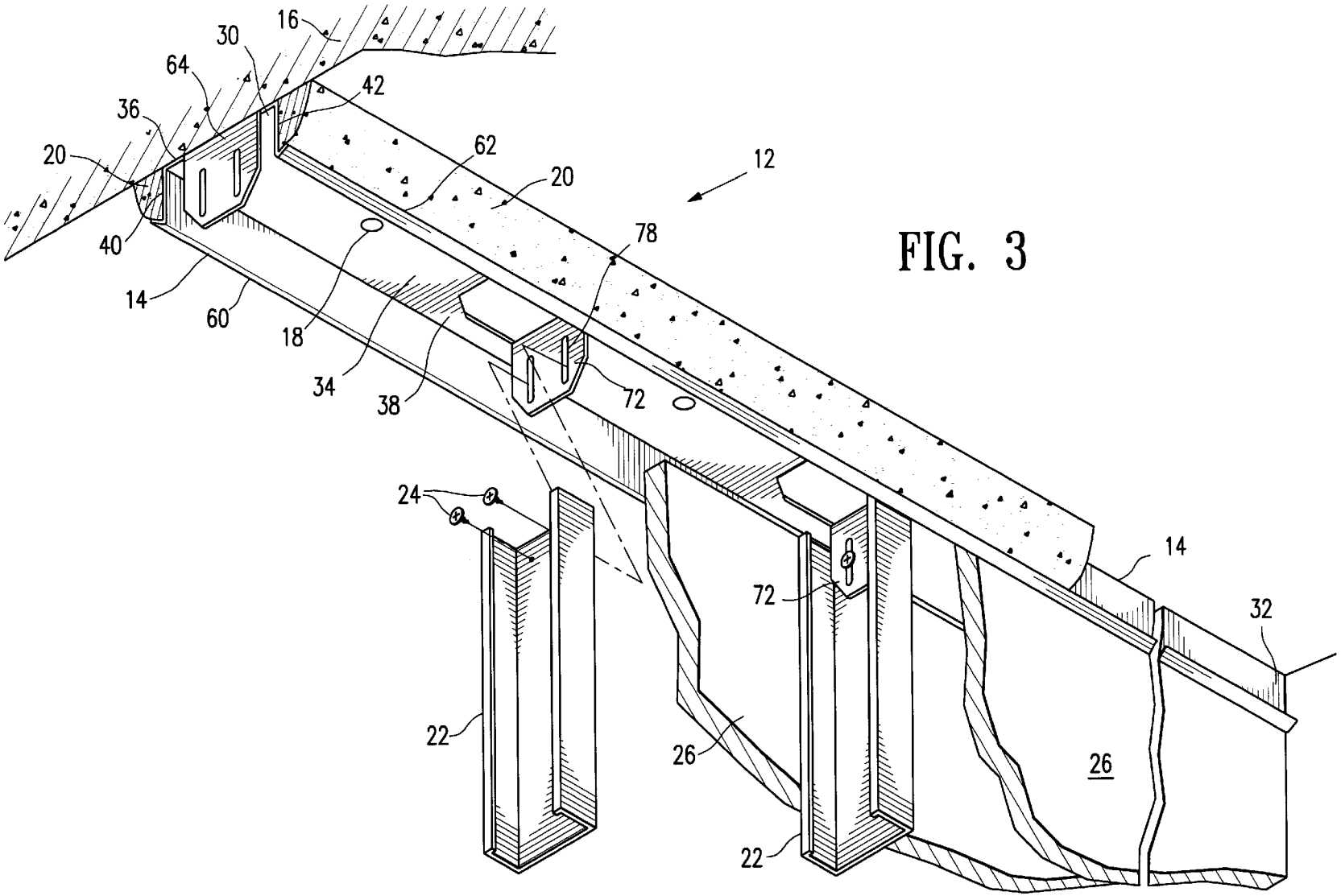
FIG. 3 is an exploded view of a first version of the track assembly of the present invention.

FIG. 3 is an exploded view of the track assembly 12 shown in FIG. 2. The track 14 has a first end 30 and a second end 32. The track 14 further has a top wall 34 with an outer surface 36 and an inner surface 38. The interior width of the top wall 34 of the track 14 is preferably determined by the width of the required or selected stud and the width of the required or selected gypsum wallboards that ride within the track 14. The thickness of the track depends on the thickness of the steel chosen. The top wall 34 is attached to the top structural member 16 via the first attachment means 18. The track 14 further has a first side wall 40 and a second side wall 42. The first side wall 40 and second side wall 42 are opposed to each other and extend or depend downwardly from and generally perpendicular to the top wall 34. Preferably, the first side wall 40 and second side wall 42 depend downwardly from the top wall 34 at an angle of about 90 degrees. The top wall 34 and side walls 40,42 define a substantially U-shaped configuration. Preferably, the length of the first side wall 40 and the second side wall 42 is in the range of about 2½ inches to about 3½ inches. More preferably, the length of the first side wall 40 and the second side wall 42 is about 3 inches. The first side wall 40 has a top end 44 and a bottom end 46, and an outer surface 48 and an inner surface 50. The second side wall 42 has a top end 52 and a bottom end 54, and an outer surface 56 and an inner surface 58. The first side wall 40 further includes an angled lip 60 depending outwardly from the bottom end 46 of the first side wall 40. The second side wall 42 also has an angled lip 62 depending outwardly from the bottom end 54 of the second side wall 42. The angled lips 60, 62 are designed to support the fireproofing material 20 and to hold or assist in holding the fireproofing material 20 in place during deflection, such as during an earthquake. Preferably, the angled lips 60, 62 depend outwardly from the first side wall and second side wall, respectively, at an angle in the range of about 30 degrees to about 75 degrees. More preferably, the angled lips depend outwardly from the side walls at an angle of about 45 degrees. Preferably, the angled lips have a width in the range of about ¼ inch to about ½ inch.

Figure 4:
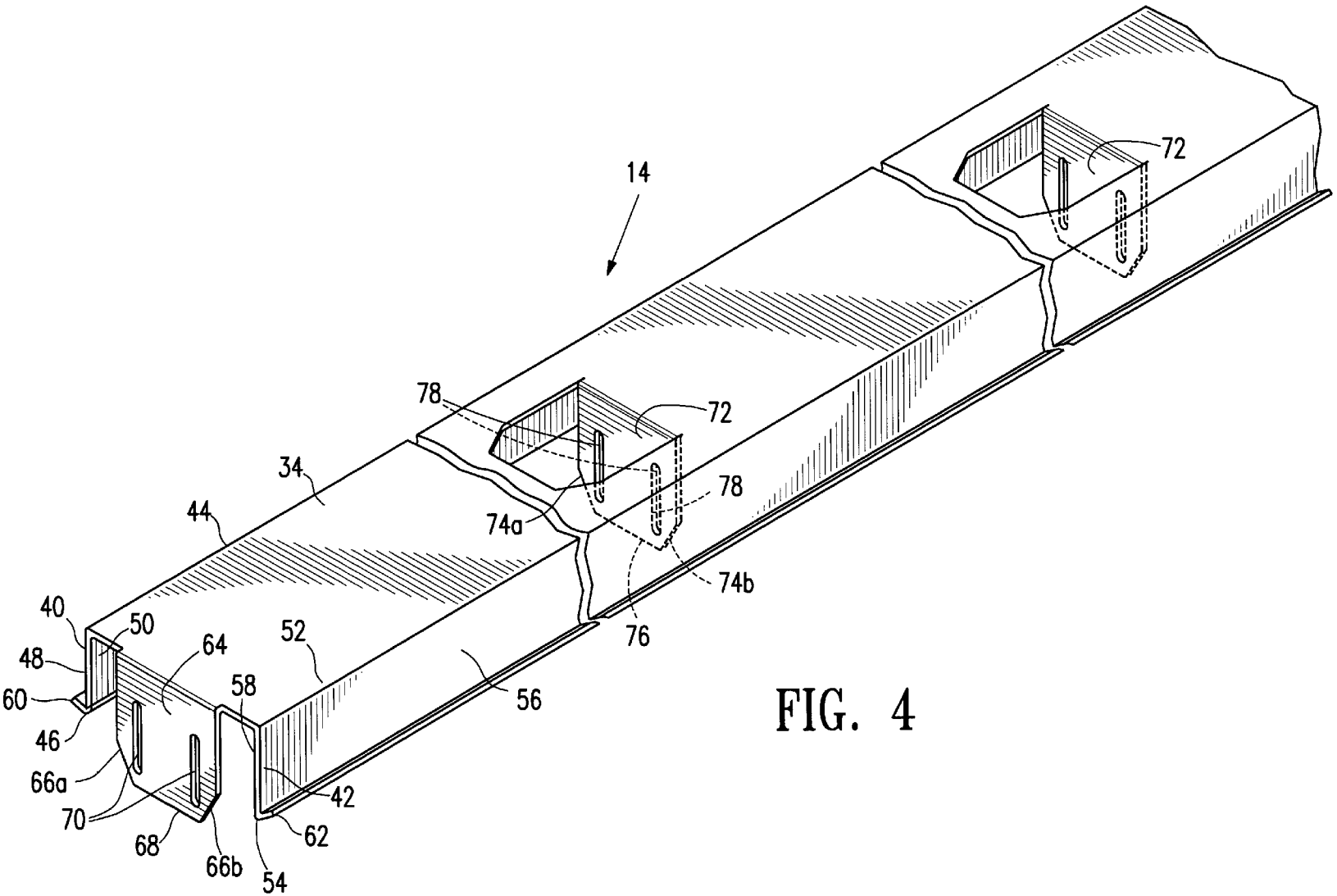
FIG. 4 is a top perspective view of a first version of the track portion of the present invention.

FIG. 4 is a top perspective view of the track 14 of the first version of the present invention. As is shown in FIG. 4, the track 14 further comprises an end tab 64 at the first end 30 of the track 14. The end tab 64 extends or depends downwardly from the top wall 34 of the track 14. Preferably, the end tab 64 extends or depends downwardly from the top wall 34 at an angle of about 90 degrees and is centered between the first side wall 40 and second side wall 42 of the track 14. Preferably, the end tab 64 is made of metal such as galvanized steel. Preferably, the end tab 64 has six sides. However, the end tab may also be of another suitable configuration. Preferably, the widest width of the end tab 64 is 1/16 inch less than the interior width of the required or selected stud used with the track. Preferably, the longest length of the end tab 64 is in the range of about 2½ inches to about 3½ inches. Sides 66*a* and 66*b* of end tab 64 are angled upwardly from bottom side 68 to make it easier to insert or guide the stud up onto the tab 64. The end tab 64 includes a plurality of longitudinal openings 70. Preferably, there are two longitudinal openings 70 formed in the end tab 64 and the longitudinal openings 70 are of equal length and dimension and are opposed to and parallel to each other. The longitudinal openings 70 have a length in the range of about 2 inches to about 2½ inches, and a width in the range of about ⅛ inch to about ¼ inch. The second attachment means 24 is inserted through the longitudinal openings 70 of the end tab 64 and into the stud 22 for securing the end tab 64 to the stud 22, while also allowing vertical movement of the stud 22 with respect to the longitudinal openings 70 of the end tab 64.

As shown more particularly in FIG. 4, the track 14 farther comprises a plurality of top tabs 72 spaced an equal distance apart along the top wall 34 of the track 14. The spacing of the top tabs 72 corresponds to the spacing of the studs 22. Preferably, the first top tab 72 after the end tab 64 is spaced a distance of about 16 inches from the end tab, and preferably, each top tab 72 is spaced about 16 inches from the next top tab. Each top tab 72 can be bent and depends downwardly from the top wall 34 of the track 14. Preferably, in this first version of the present invention, the top tabs 72 are bent or depend downwardly from the top wall 34 at an angle of about 90 degrees and are centered between the first side wall 40 and the second side wall 42 of the track 14. Preferably, the top tabs 72 are made of metal such as galvanized steel and are punched into the track during manufacturing. Preferably, the top tabs 72 have six sides and are of substantially the same size and configuration as the end tab 64. However, the top tabs may also be of another suitable configuration. Preferably, the widest width of the top tab 72 is 1/16 inch less than the interior width of the required or selected stud used with the track. Preferably, the longest length of the top tab 72 is in the range of about 2½ inches to about 3½ inches. Sides 74*a* and 74*b* of top tabs 72 are angled upwardly from bottom side 76 to make it easier to insert or guide the stud up onto the tab 72. The top tabs 72 also include a plurality of longitudinal openings 78, being of substantially the same size and configuration as the longitudinal openings 70 of the end tab 64. Preferably, there are two longitudinal openings 78 formed in the top tabs 72 and the longitudinal openings 78 are of equal length and dimension and are parallel to each other. The longitudinal openings 78 have a length in the range of about 2 inches to about 2½ inches, and a width in the range of about ⅛ inch to about ¼ inch. The second attachment means 24 is inserted through the longitudinal openings 78 of the top tabs 72 and into the stud 22 for securing the top tabs 72 to the stud 22, while also allowing vertical movement of the stud 22 with respect to the longitudinal openings 78 of the top tabs 72.

By making the end tab 64 and top tabs 72 with longitudinal openings 70, 78, respectively, for attachment of the studs 22 via second attachment means 24, there is no edge or portion of the assembly riding up and down on the outer side of the metal stud during cycling or deflection. FIG. 3 also shows the gypsum wallboards 26 installed along each outer side of the stud 22. The upper portions of the gypsum wallboards 26 also ride within the track 14 upon deflection.

Figure 5:
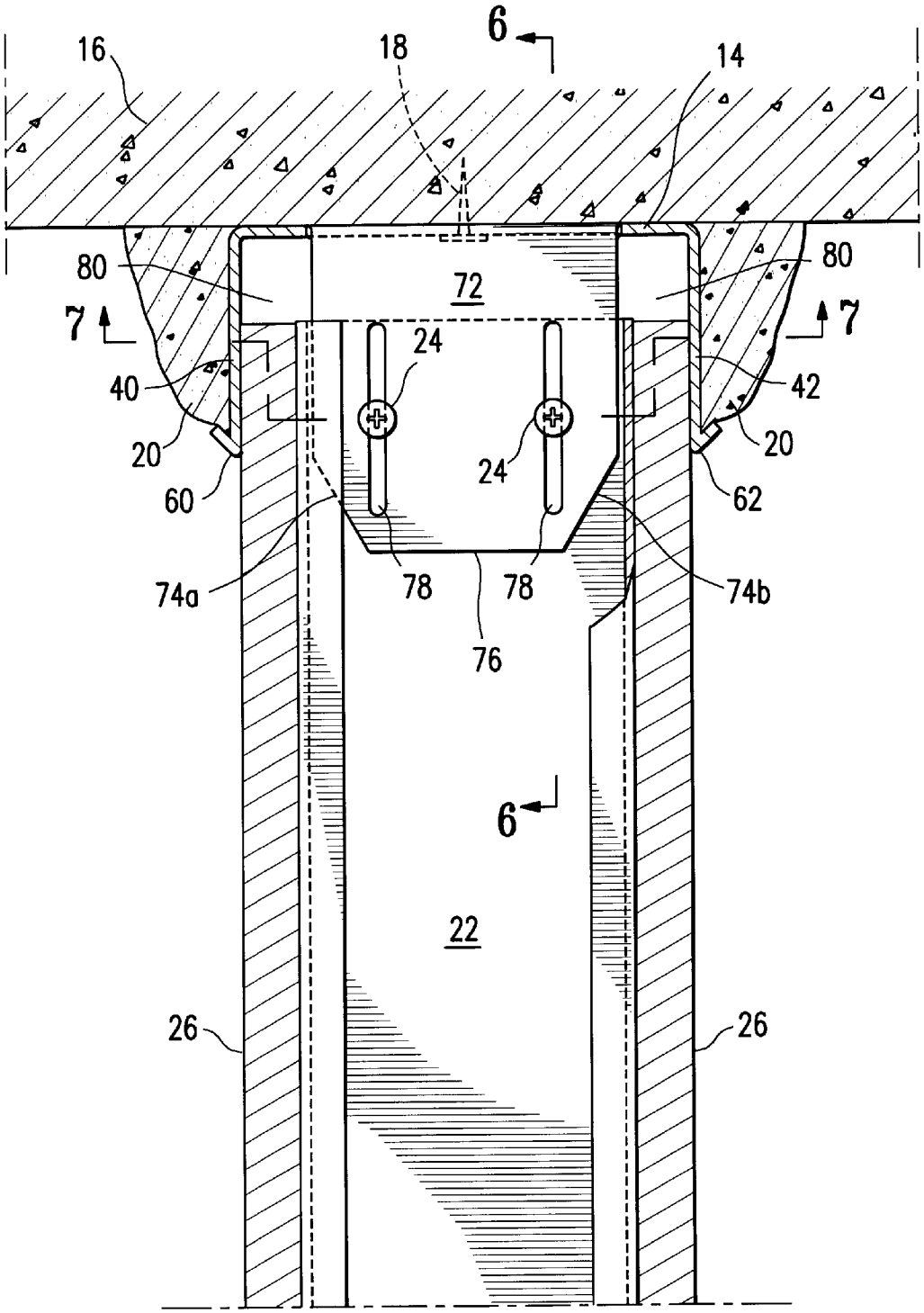
FIG. 5 is a sectional view of a first version of the track assembly in the direction of line 5—5 of FIG. 2.

FIG. 5 is a sectional view of the track assembly 12 in the direction of line 5—5 of FIG. 2. The track 14 forms a cap configuration over the upper portions of both the stud 22 and the gypsum wallboards 26 attached to each side of the stud 22. During deflection, the track 14 is adapted to slidably receive the stud 22 and gypsum wallboards 26 adjacent the stud 22, while also maintaining positive attachment of the track 14 to the top structural member 16. Upon deflection, the stud 22 which is attached to the top tab 72 via second attachment means 24 rides with the attachment means 24 vertically upwardly and downwardly along the longitudinal openings 78. Fireproofing material 20 is shown adjacent the outer surface 48 of the first side wall 40 and adjacent the outer surface 56 of the second side wall 42. The fireproofing material 20 is supported on the angled lips 60, 62. A gap 80 for deflection is shown in between the top of the gypsum wallboards 26 and the inner surface 38 of the top wall 34 of the track 14. Preferably, this gap 80 comprises a 1¼ inches deflection area from the inner surface 38 of the top wall 34 of the track 14 to the top of the gypsum wallboards 26 and from the inner surface 38 of the top wall 34 of the track 14 to the tops of the studs.

Figure 6:
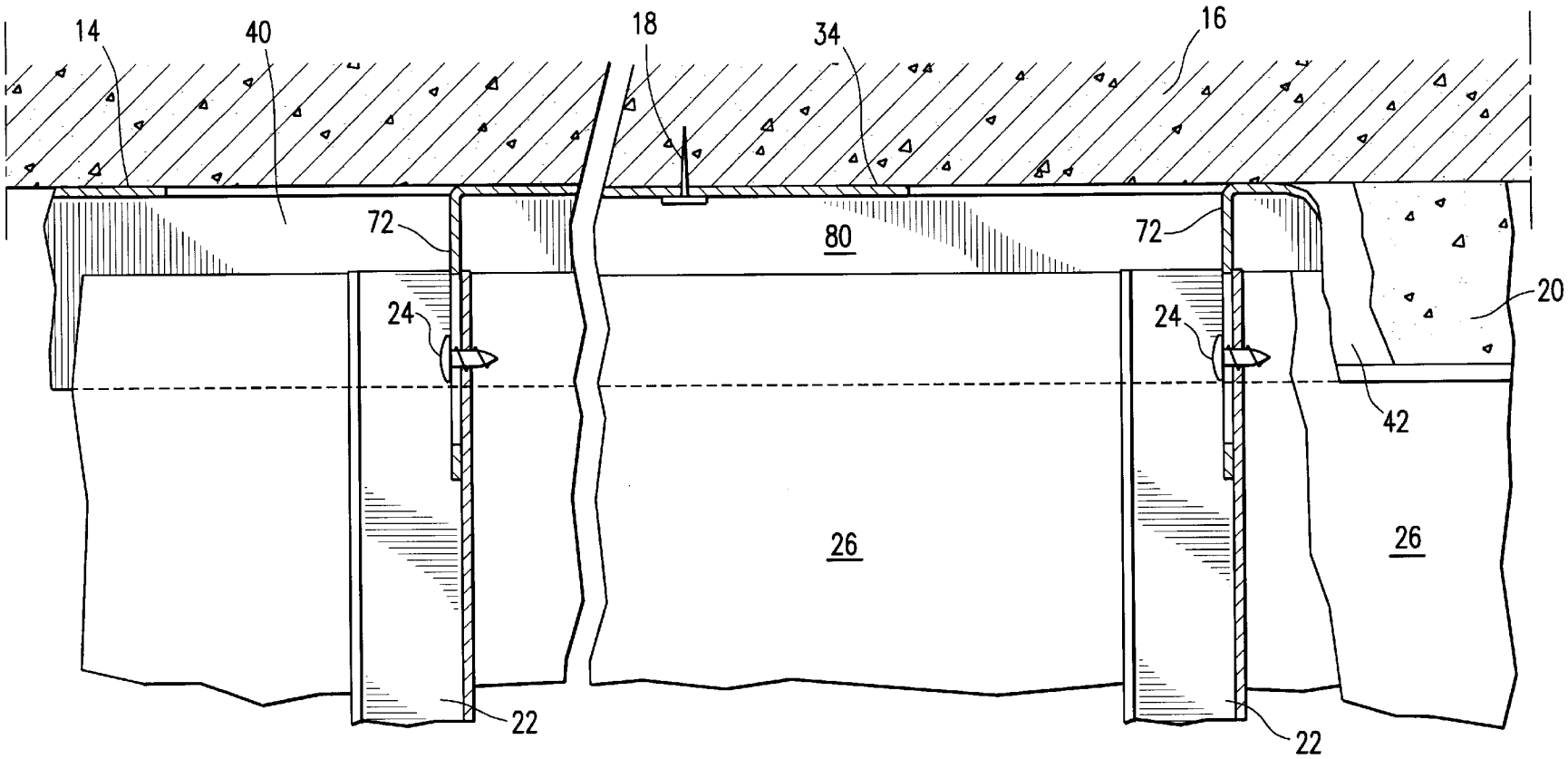
FIG. 6 is a sectional view of a first version of the track assembly in the direction of line 6—6 of FIG. 5.
Figure 7:
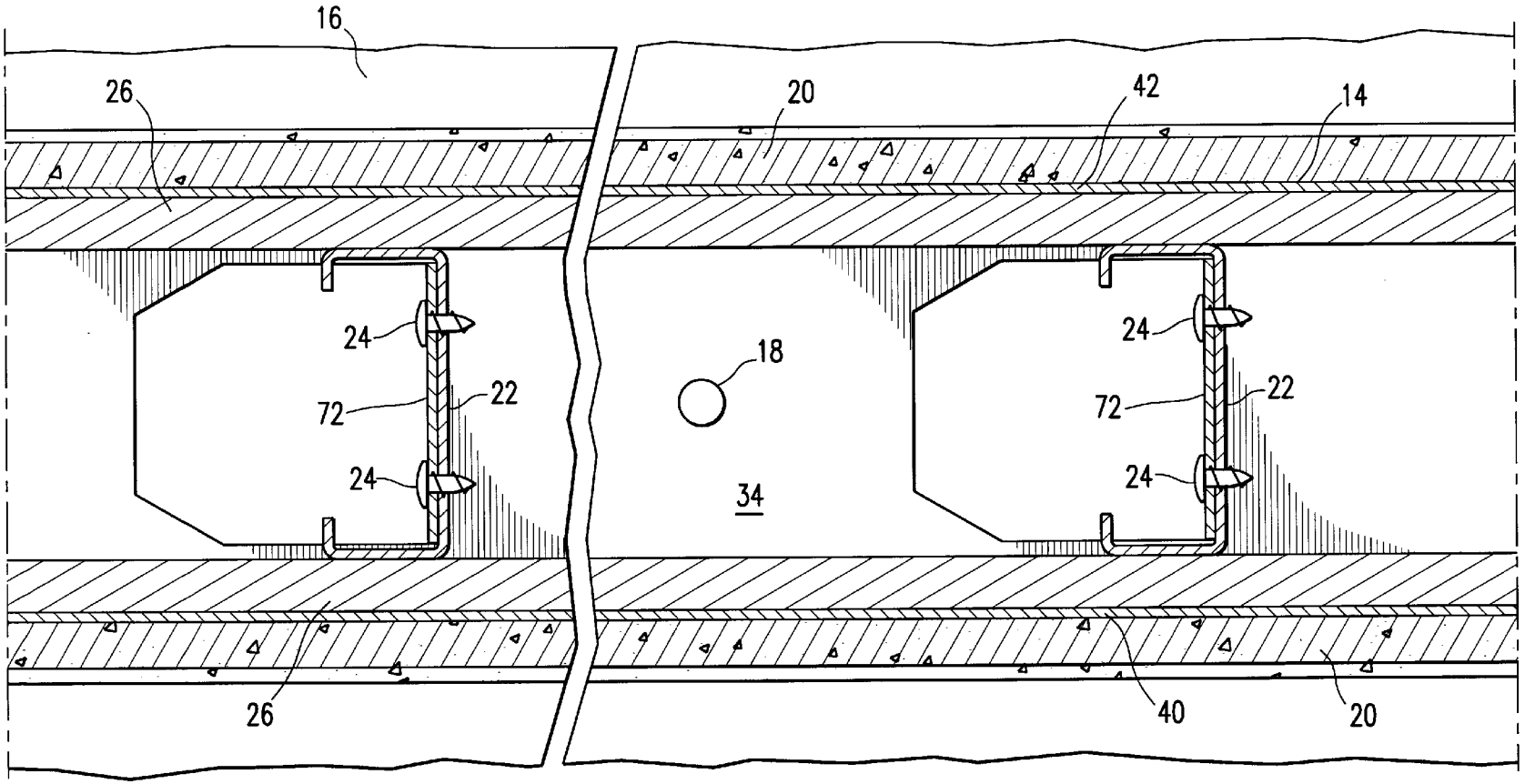
FIG. 7 is a sectional view of a first version of the track assembly in the direction of line 7—7 of FIG. 5.

FIG. 6 is a sectional view of the track assembly in the direction of line 6—6 of FIG. 5. FIG. 7 is a sectional view of the track assembly in the direction of line 7—7 of FIG. 5. With this first version and other versions of the present invention, additional separate pre-formed metal tabs bent at a 90 degree angle and having substantially the same shape, configuration, and dimensions as the end tab and top tabs, can be used and attached to the track in instances where the track does not align with the floor layout, such as with door and window openings that require a stud not on the layout. These separate tabs may be attached via attachment means such as screws.

Figure 8:
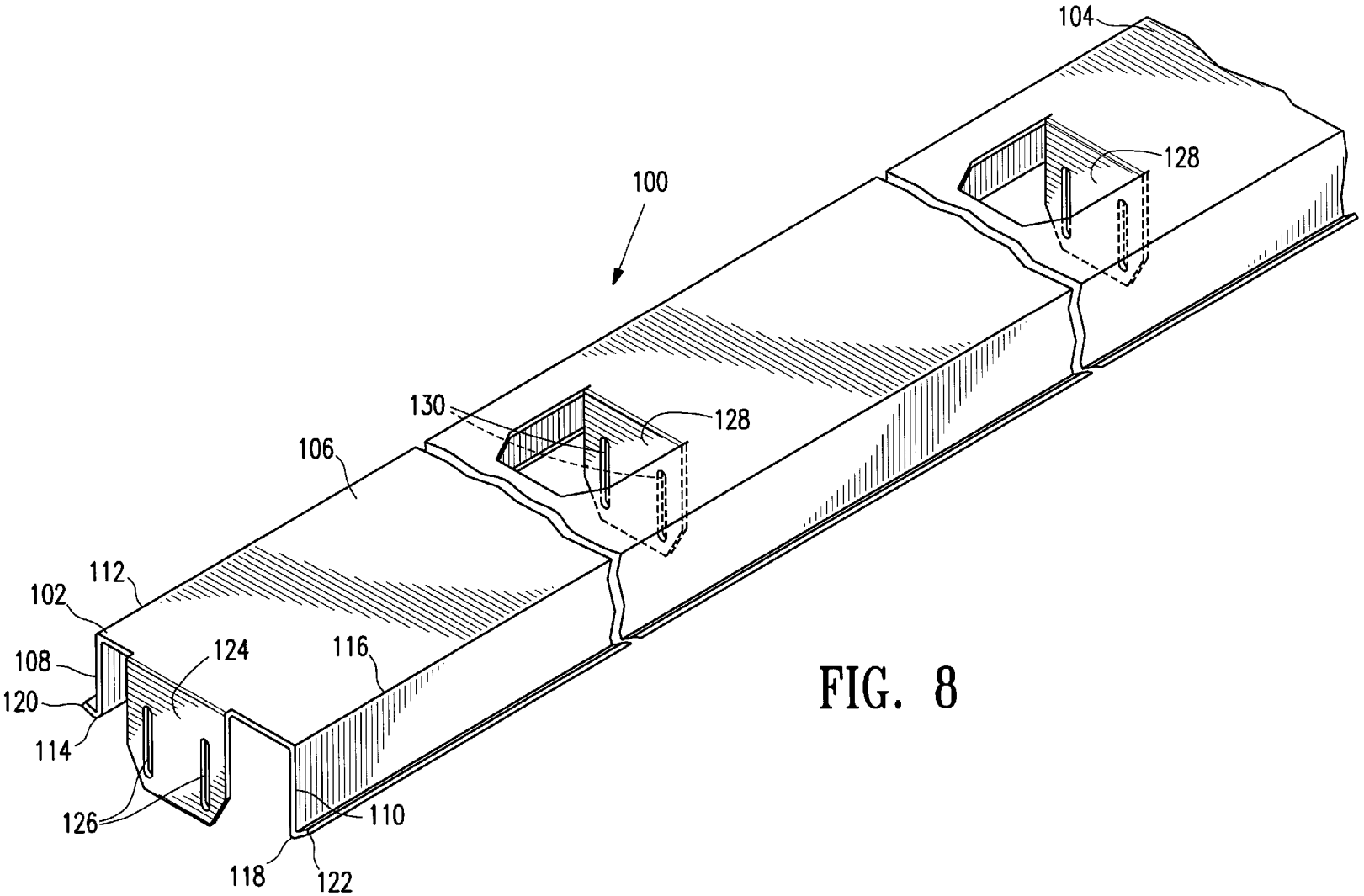
FIG. 8 is a top perspective view a second version of the track assembly of the present invention.
Figure 9:
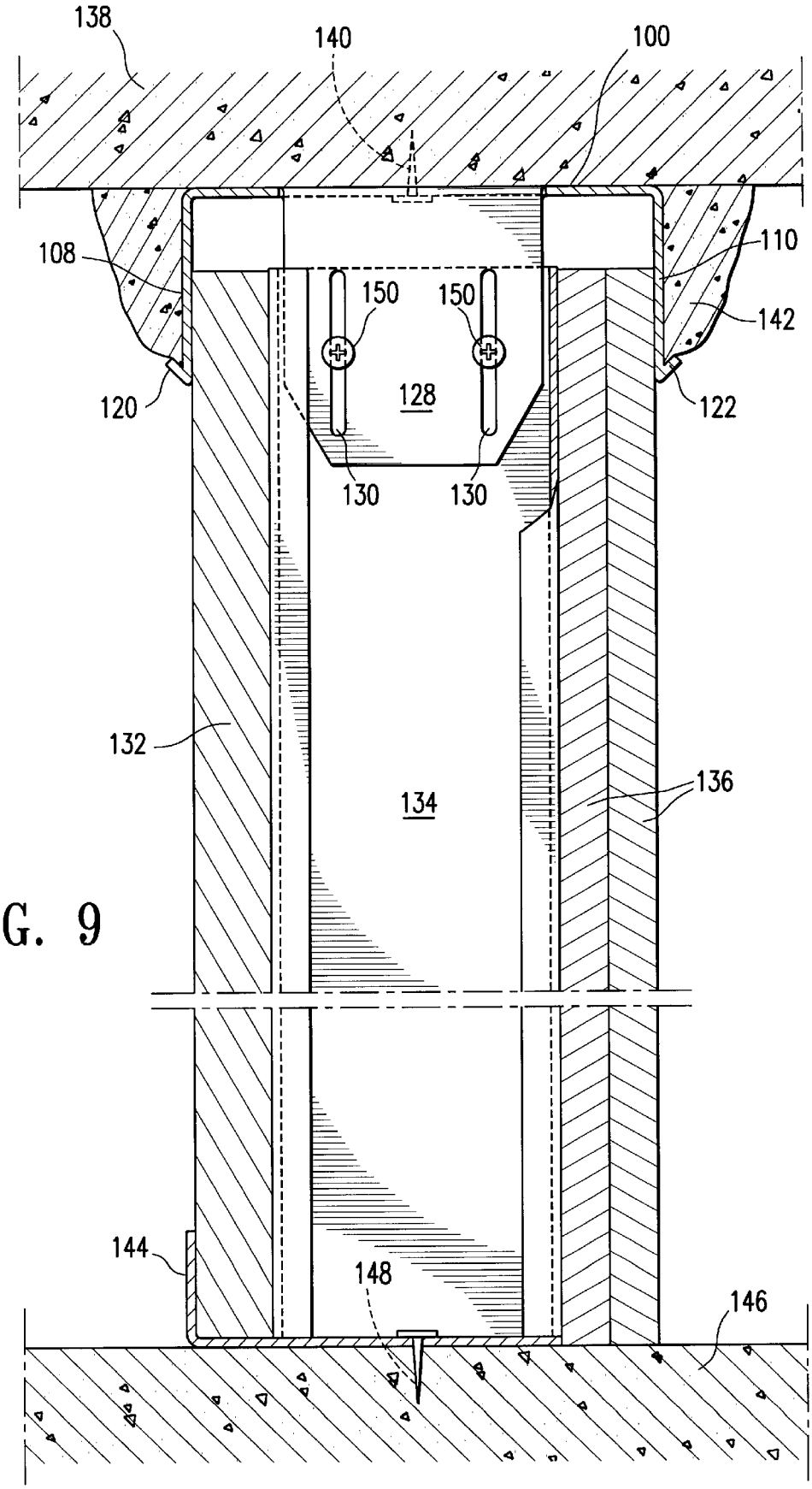
FIG. 9 is a vertical sectional view of a second version of the track assembly of the present invention for a two-hour fire rated wall.
Figure 10:
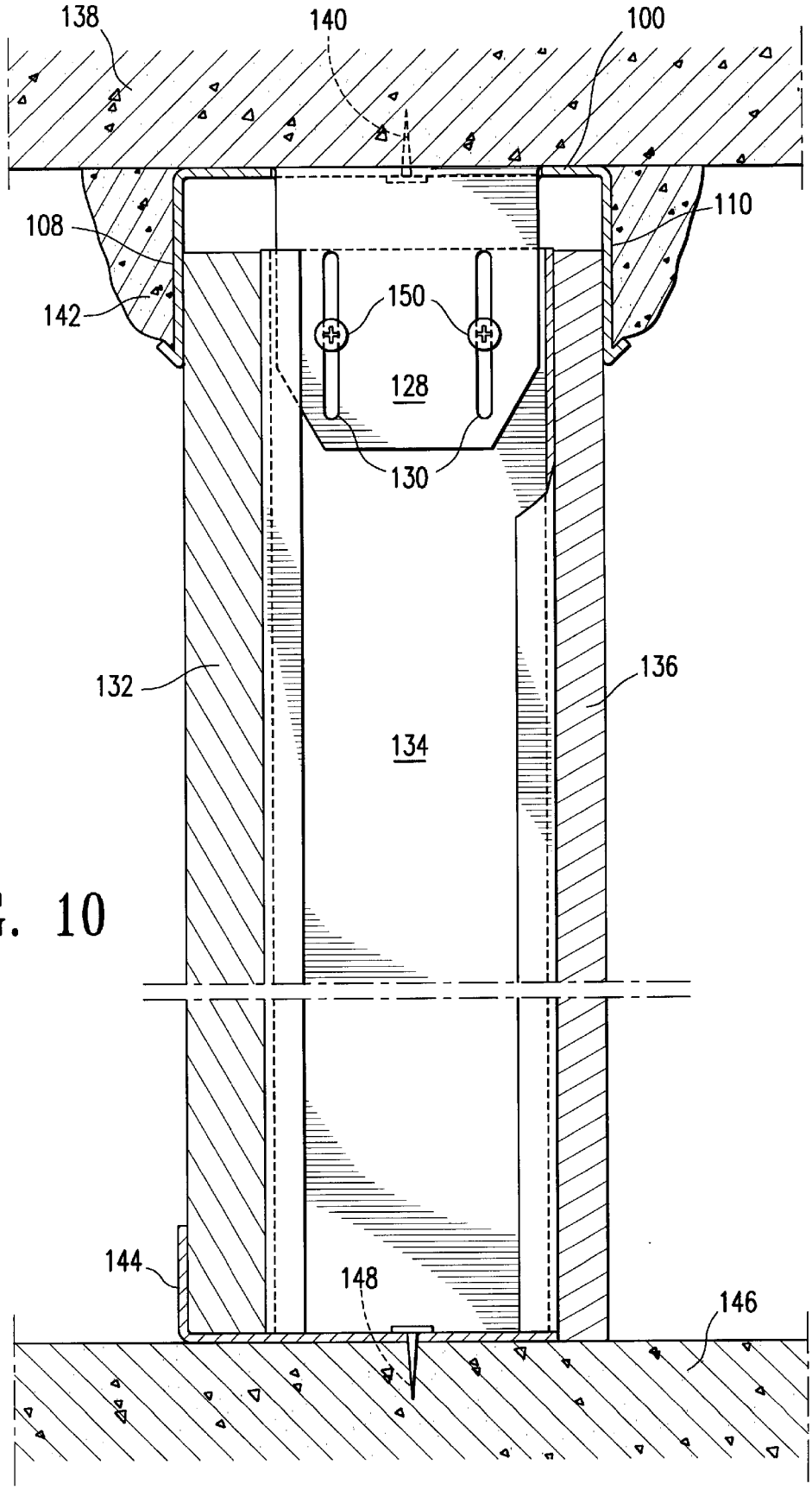
FIG. 10 is a vertical sectional view of a second version of the track assembly of the present invention for a one-hour fire rated wall.

A second version of the present invention is shown in FIGS. 8–10. The second version provides a track assembly which can be used with a fire resistant shaft wall structure, such as an elevator shaft. FIG. 8 shows a top perspective view of a track 100 having a first end 102 and a second end 104, and a top wall 106, a first side wall 108 and a second side wall 110. The first and second side walls 108, 110, are opposed to each other each and depend downwardly from and generally perpendicular to the top wall 106, preferably at an angle of 90 degrees. The top wall 106 and side walls 108, 110, define a substantially U-shaped configuration. The first side wall 108 has a top end 112 and a bottom end 114. The second side wall 110 has a top end 116 and a bottom end 118. The first side wall 108 further includes an angled lip 120 depending outwardly from the bottom end 114 of the first side wall 108. The second side wall 110 also has an angled lip 122 depending outwardly from the bottom end 118 of the second side wall 110. The angled lips 120, 122 are designed to support fireproofing material and to hold or assist in holding the fireproofing material in place during deflection, such as during an earthquake. Preferably, the angled lips 120,122 depend outwardly from the first side wall and second side wall, respectively, at an angle in the range of about 30 degrees to about 75 degrees. More preferably, the angled lips depend outwardly from the side walls at an angle of about 45 degrees. An end tab 124 is at the first end 102 of the track 100. The end tab 124 extends or depends downwardly from the top wall 106 of the track 100. Preferably, the end tab 124 extends or depends downwardly from the top wall 106 at an angle of about 90 degrees. In this version of the present invention, the end tab 124 is positioned off center between the first side wall 108 and second side wall 110 of the track 100. For a two-hour fire rated wall assembly, as shown in FIGS. 8 and 9, the end tab and top tabs on the longitudinal track are not centered between the side walls of the track but are off center to compensate for the smaller width of the back layer of gypsum wallboard installed along the back side of the stud and the larger width of the two front layers of gypsum wallboard installed along the front side of the stud.

For both a track assembly used with a two-hour fire rated elevator shaft wall, as shown in FIGS. 8 and 9, and a one-hour fire rated elevator shaft wall, as shown in FIG. 10, there is a space between the first side wall 108 and the side of the end tab 124 closest to the first side wall, wherein such space has a width in the range of about 1 1/16 inches to about 1⅛ inches, and the space is adapted to receive one gypsum wallboard. In addition, for a track assembly used with a two-hour fire rated elevator shaft wall, as shown in FIGS. 8 and 9, there is a space between the second side wall 110 and the side of the end tab 124 closest to the second side wall, wherein such space has a width in the range of about 1 5/16 inches to about 1 7/16 inches and the space is adapted to receive two gypsum wallboards. In addition, for a track assembly used with a one-hour fire rated elevator shaft wall, as shown in FIG. 10, there is a space between the second side wall 110 and the side of the end tab 124 closest to the second side wall, wherein such space has a width in the range of about 1 1/16 inch to about ¾ inch and is adapted to receive one gypsum wallboard.

As shown in FIG. 8, the end tab 124 further includes a plurality of longitudinal openings 126. The end tab 124 and longitudinal openings 126 are substantially the same size and dimension as the end tab 64 and longitudinal openings 70 in the first version of the invention. The track 100 further includes a plurality of top tabs 128 spaced an equal distance apart along the top wall 106 of the track. Each top tab 128 can be bent and depends downwardly from the top wall 106 of the track 14. Preferably, each top tab 128 extends or depends downwardly from the top wall 106 at an angle of about 90 degrees. In this version of the present invention, each top tab 128 is positioned off center between the first side wall 108 and second side wall 110 of the track 100. Each top tab 128 is preferably spaced 24 inches apart from the end tab or from another top tab. For a track assembly used with both a two-hour fire rated elevator shaft wall, as shown in FIGS. 8 and 9, and a one-hour fire rated elevator shaft wall, as shown in FIG. 10, there is a space between the first side wall 108 and the side of the top tab 128 closest to the first side wall, wherein such space has a width in the range of about 1 1/16 inches to about 1 1/18 inches and is adapted to receive one gypsum wallboard. In addition, for a track assembly used with a two-hour fire rated elevator shaft wall, as shown in FIGS. 8 and 9, there is a space between the second side wall 110 and the side of the top tab 128 closest to the second side wall, wherein such space has a width in the range of about 1 5/16 inches to about 1 7/16 inches and is adapted to receive two gypsum wallboards. In addition, for a track assembly used with a one-hour fire rated elevator shaft wall, as shown in FIG. 10, there is a space between the second side wall 110 and the side of the top tab 128 closest to the second side wall, wherein such space has a width in the range of about 11/16 inch to about ¾ inch and is adapted to receive one gypsum wallboard.

The top tabs 128 further includes a plurality of longitudinal openings 130. The top tabs 128 and longitudinal openings 130 are substantially the same size and dimension as the top tabs 72 and longitudinal openings 78 in the first version of the invention.

FIG. 9 is a vertical sectional view of a second version of the track assembly of the present invention installed into a two-hour fire rated elevator shaft structure. For a two-hour fire rated wall assembly, the top tab 128 depending from the top wall 106 of the track 100 is not centered between the track 100 but is off center to compensate for a back layer of gypsum wallboard 132 on the back side of the stud 134 and a plurality of front layers, preferably two, of gypsum wallboards 136 on the front side of the stud 134. For both a one-hour and two-hour fire rated shaft wall assembly, the width of the back layer of gypsum wallboard 132 is preferably one inch. For a two-hour wall, preferably the entire width of the front two layers of gypsum wallboards 136 is about 1 5/16 inches to about 1 7/16 inches. For a one-hour wall, as shown in FIG. 10, preferably the width of the front layer of gypsum wallboard 136 is about ⅝ inch.

Typically, the stud 134 is in the configuration of an "I" or a "CH." The top wall 106 of the track 100 is attached to a top structural member 138 or deck via a first attachment means 140, preferably a concrete nail. A fireproofing material 142, such as the preferred fireproofing material discussed above, is applied on the outer sides of the first side wall 108 and the second side wall 110 and is supported in the angled lips 120, 122 of the side walls. The bottom of the gypsum wallboard 132 and the bottom of the stud 134 are positioned within a conventional metal "J" track 144 of the type used in elevator shafts. The "J" track 144 is attached to a bottom floor member 146 via a third attachment means 148, preferably a conventional screw or another suitable attachment means.

FIG. 10 is a vertical sectional view of the second version of the track assembly of the present invention installed into a one-hour fire rated wall structure. For a one-hour fire rated wall assembly, the end tab and top tabs on the longitudinal track are not centered between the side walls of the track but are off center to compensate for the larger width of the back layer of gypsum wallboard 132 installed along the back side of the stud and the smaller width of the front layer of gypsum wallboard 136 installed along the front side of the stud.

This second version allows for the up and down deflection while maintaining positive attachment to the overhead structure. In this version the metal stud 134 is preferably positioned every 24 inches in alignment with the end tab 124 and top tabs 128, and the end tab 124 and top tabs 128 are bent downwardly at a 90 degree angle. Second attachment means 150, preferably conventional screws, are then screwed into the "I" or "CH" studs through the longitudinal openings 126, 130 in the end tab 124 and top tabs 128, respectively. During deflection, the track 100 rides up and down along on the wall assembly, in lieu of using the standard "J" track. In addition, during deflection, the upper portions of the gypsum wallboards 132, 136 and the upper portion of the stud 134 ride up and down in the track 100. With this version of the present invention, additional separate pre-formed metal tabs bent at a 90 degree angle and having substantially the same shape, configuration, and dimensions as the end tab and top tabs, can be used and attached to the track in instances where the track does not align with the floor layout.

Figure 11:
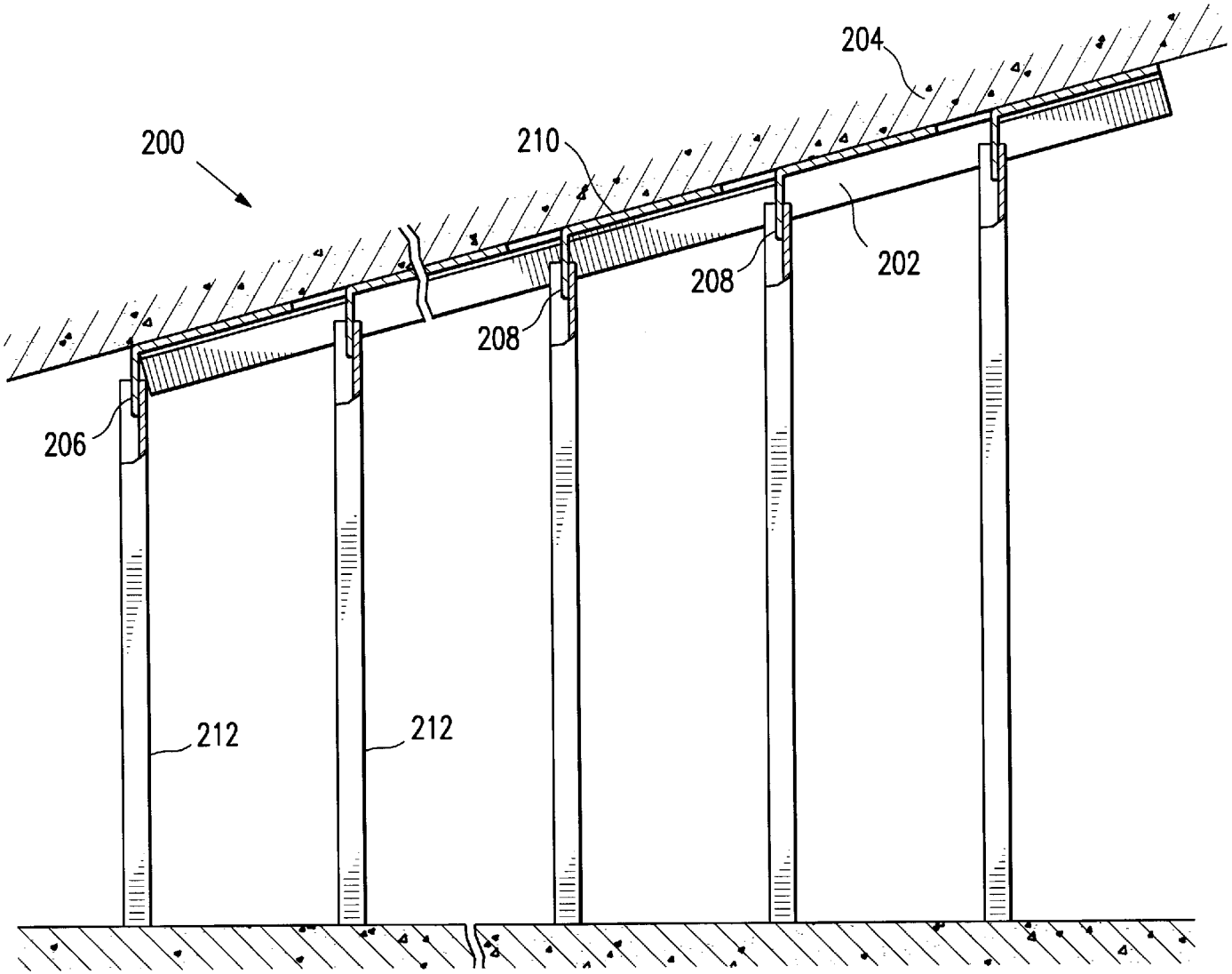
FIG. 11 is a side view of a third version of the track assembly of the present invention.

FIG. 11 is a side view of a third version of the track assembly of the present invention. In this version, a track assembly 200 is used with a fire resistant wall structure, and a track 202 is adapted for attachment to an inclined top structural member 204 or inclined overhead structure, such as a roof. With this version of the invention, the spacing of the end tab 206 and top tabs 208 along the top wall 210 of the track is designed to correspond to the layout of metal studs 212 along a bottom floor structure. In addition, the angle of the bend of the end tab 206 and top tabs 208 in the track is about 90 degrees to the bottom floor structure regardless of the degree of incline of the overhead structure. A preferred fireproofing material (not shown), as described above, is also applied to the exterior sides of the track and the bottom of the top structural member.

With this third version, by changing the layout of the tabs to correspond to the layout of the metal studs, a consistent metal stud layout is maintained, matching a bottom floor structure layout. The tops of the gypsum wallboards ride in the track to allow for deflection. In addition, preferably with this version of the invention, the first top tab after the end tab is spaced a distance of about 16 inches from the end tab, and preferably, each top tab is spaced about 16 inches from the next top tab. In addition, with this version of the present invention, additional pre-formed separate metal tabs bent at a 90 degree angle and having substantially the same shape, configuration, and dimensions as the end tab and top tabs, can be used and attached to the track in instances where the track does not align with the floor layout, such as with door and window openings that require a stud not on the layout.

Figure 13:
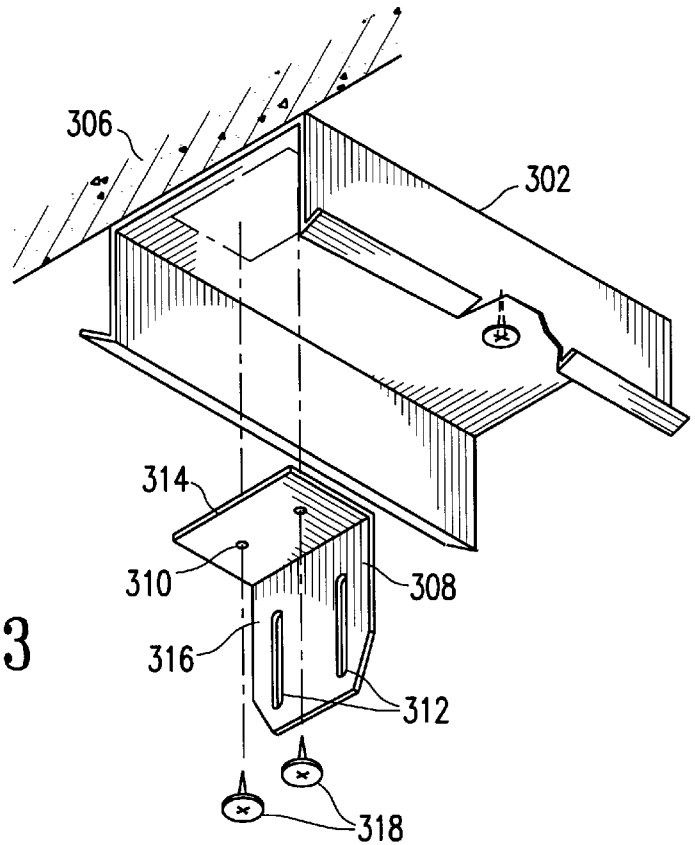
FIG. 13 is a perspective view of a fourth version of the track assembly of the present invention; and, FIG. 14 is a top view of a fourth version of the track assembly of the present invention.
Figure 12:
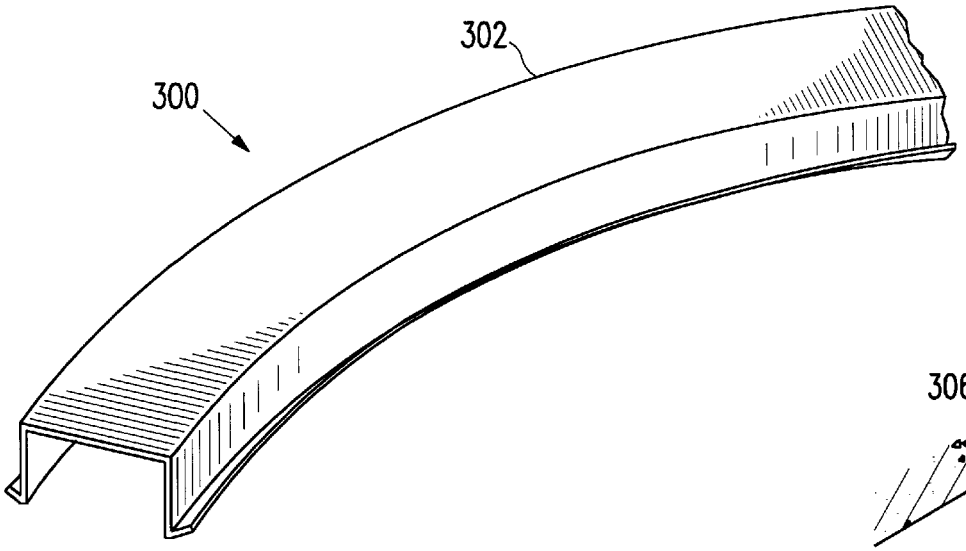
FIG. 12 is a perspective view of the track portion of a fourth version of the present invention.
Figure 14:
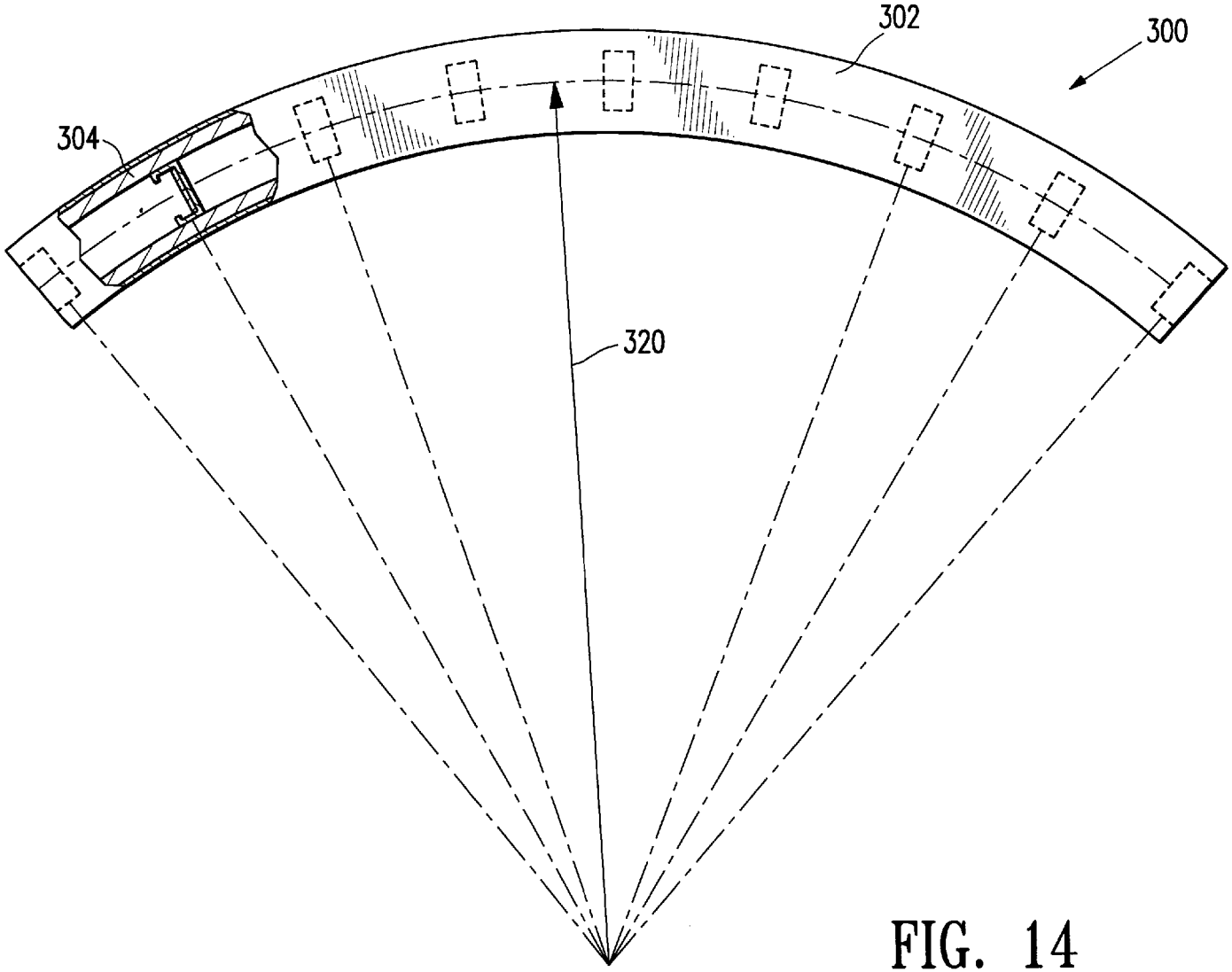

With reference to FIGS. 12–14, a fourth version of a track assembly 300 of the present invention is shown. FIG. 12 is a perspective view of the fourth version of the track assembly 300 of the present invention. FIG. 13 is a perspective view of the tab used with the fourth version of the track assembly of the present invention. FIG. 14 is a top view of the fourth version of the track assembly of the present invention. Referring to FIGS. 12–14, in this version of the present invention, a curved track 302 is used with a curved or radiused fire resistant wall structure 304, such as a C-shaped or S-shaped wall. The track 302 is attached to a top structural member 306, such as a ceiling. Rather than having tabs punched into the track as in the versions described above, this version of the invention uses separate preformed metal tabs 308 bent at a 90 degree angle and having a plurality of substantially circular apertures 310, preferably two, and a plurality of longitudinal openings 312, preferably two. The tabs 308 are substantially the same shape, configuration, and dimension as the end tab and top tabs used in the versions described above. The tabs 308 have a top portion 314 and a side portion 316. The top portion 314 has apertures 310 for receiving first attachment means 318. Preferably, the first attachment means is a plurality of conventional screws or other suitable attachment means. The first attachment means 318 are inserted into apertures 310 and inserted into the curved wall 304 so that the track is secured to the curved wall 304. Thus, the tabs are individually installed into the track via first attachment means. The side portion 316 of the tab has longitudinal openings 312 for receiving a plurality of second attachment means such as screws (not shown) or other suitable attachment means, where the second attachment means are inserted into the longitudinal openings for attachment of the tab to a vertical stud (not shown). With this version of the invention, the positioning of the tabs 308 along the track is determined by the length of the radius 320 of the curve of the wall 304. A preferred fireproofing material (not shown), as described above, is also applied to the exterior sides of the track and the bottom of the top structural member.

The present invention is also directed to a method of installing the track assembly of the present invention into a fire resistant wall structure. The method is directed to installing a track assembly in a cyclical design fire resistant wall structure comprising: providing the track assembly according to the present invention described above; mounting the top wall of the track assembly to a top structural member via a first attachment means; positioning a plurality of vertically extending studs between a bottom structural member and the top structural member wherein the upper portions of the studs are in alignment with the end tab and top tabs of the track and wherein the upper portions of the studs are positioned within the track; attaching the studs to the end tab and top tabs of the track with a second attachment means by passing the second attachment means through the longitudinal openings of the end tab and top tabs and into the studs so as to allow vertical movement upwardly and downwardly along the longitudinal openings; and installing a plurality of gypsum wallboards on each side of the studs so that the tops of the gypsum wallboards are within the track and move vertically upwardly and downwardly within the track upon deflection.

Although the present invention has been described in considerable detail with reference to certain preferred versions thereof, other versions of the invention are possible. Therefore, the scope of the appended claims should not be limited to the description of the preferred versions contained herein.

What is claimed is:

1. A track assembly for use with a fire resistant wall structure, the track assembly adapted for attachment to atop structural member and to a plurality of wall studs, the track assembly comprising:

(a) a longitudinal track having:

(i) a first end and a second end;

(ii) a top wall, and first and second opposed side walls each depending downwardly from and generally perpendicular to the top wall, each side wall having a top end and a bottom end, and the top wall and side walls defining a substantially U-shaped configuration;

(iii) an angled lip extending outwardly from the bottom end of each of the side walls and extending as an angle with respect to said top wall;

(iv) an end tab at the first end of the track, the end tab depending downwardly from the top wall of the track;

(v) a plurality of top tabs spaced an equal distance apart along the top wall of the track, each top tab depending downwardly from the top wall of the track;

(vi) a plurality of longitudinal openings formed within the end tab and top tabs;

(b) a plurality of first attachment means passing through the top wall of the track and adapted to be attached to the top structural member for securing the top wall of the track to the top structural member;

(c) a plurality of second attachment means passing through the longitudinal openings of the end tab and top tabs and adapted to be attached to the studs for securing the end tab and top tabs of the track to the studs, while also allowing vertical movement of the studs with respect to the longitudinal openings of the tabs; and, (d) a fire resistant material extending along the outer side walls of the track and supported on the lip of each of the side walls;

wherein during deflection, the track assembly is adapted to slidably receive within the track the studs and a plurality of gypsum wallboards adjacent the studs, while maintaining attachment of the track assembly to the top structural member.

2. The track assembly of claim 1 wherein the fire resistant wall structure is an elevator shaft wall structure.

3. The track assembly of claim 1 wherein the longitudinal track is made of galvanized steel.

4. The track assembly of claim 1 wherein the lip has a width in the range of between ¼ inch and ½ inch and depends outwardly from each of the side walls at an angle in the range of between 30 degrees and 75 degrees.

5. The track assembly of claim 4 wherein the angle is 45 degrees.

6. The track assembly of claim 1 wherein the end tab and each of the top tabs have two equally sized longitudinal openings spaced opposite to and parallel to each other.

7. The track assembly of claim 1 wherein the end tab and each of the top tabs depend downwardly from the top wall at an angle of 90 degrees.

8. The track assembly of claim 1 wherein the end tab and each of the top tabs is centered between the opposed side walls of the track.

9. The track assembly of claim 1 wherein the end tab and each of the top tabs is off center between the opposed side walls of the track.

10. The track assembly of claim 1 wherein the end tab and each of the top tabs are adapted to have a widest width of at least 1/16 of an inch less than an interior width of a stud, and wherein the end tab and the top tabs have a length in the range of between 2½ inches and 3½ inches.

11. The track assembly of claim 1 wherein the end tab is spaced apart from the top tab closest to the end tab at a distance of 16 inches, and wherein each top tab is spaced apart from the next top tab at distance of 16 inches.

12. The track assembly of claim 1 wherein the end tab is spaced apart from the top tab closest to the end tab at a distance of 24 inches, and wherein each top tab is spaced apart from the next top tab at distance of 24 inches.

13. The track assembly of claim 1 wherein the first attachment means comprises a concrete nail.

14. The track assembly of claim 1 wherein the second attachment means comprises a screw.

15. The track assembly of claim 1 wherein the fire resistant material comprises a lightweight gypsum-aggregate plaster fireproofing material.

16. The track assembly of claim 1 wherein the track assembly is adapted to have a 1¼ inches deflection gap from the inside of the top wall of the track to tops of gypsum wallboards and tops of the studs.

17. The track assembly of claim 1 wherein separate preformed metal tabs bent at a 90 degree angle and having substantially the same shape, configuration, and dimensions as the end tab and top tabs.

18. A cap track assembly for use in a cyclical design fire resistant wall structure, the wall structure having a plurality of studs and a plurality of gypsum boards, and the cap track assembly, studs, and sum boards being installed between a top structural member and a bottom structural member, the cap track assembly comprising:

(a) a longitudinal metal track having:

(i) a first end and a second end;

(ii) a top wall, and first and second opposed side walls each depending downwardly from and generally perpendicular to the top wall, each side wall having a top end and a bottom end, and the top wall and side walls defining a substantially U-shaped configuration;

(iii) an angled lip extending outwardly from the bottom end of each of the side walls and extending at an angle with respect to said top wall;

(iv) an end tab at the first end of the track, the end tab depending downwardly from and perpendicular to the top wall of the track;

(v) a plurality of top tabs spaced an equal distance apart along the top wall of the track, each top tab depending downwardly from and perpendicular to the top wall of the track;

(vi) a plurality of longitudinal openings formed within the end tab and top tabs;

(b) a plurality of first attachment means passing through the top wall of the track and adapted to be attached to the top structural member for securing the top wall of the track to the top structural member;

(c) a plurality of second attachment means passing through the longitudinal openings of the end tab and top tabs and adapted to be attached to the studs for securing the end tab and top tabs of the track to the stud assembly, while also allowing vertical movement of the studs with respect to the longitudinal openings of the tabs; and, (d) a lightweight gypsum-aggregate plaster fireproofing material extending along the outer side walls of the track and supported on the lip of each of the side walls;

wherein during deflection, the track assembly is adapted to slidably receive within the track the studs and gypsum boards, while maintaining attachment of the track assembly to the top structural member.

19. The track assembly of claim 18 wherein the end tab and the top tabs are centered between the side walls of the track, and wherein the end tab is spaced apart from the top tab closest to the end tab at a distance of 16 inches, and wherein each top tab is spaced apart from the next top tab at a distance of 16 inches.

20. A cap track assembly for use in a cyclical design fire resistant elevator shaft structure, the cap track assembly adapted to be attached to a top structural member and the cap track assembly adapted to have a plurality of studs and a plurality of gypsum boards that move vertically upwardly and downwardly within the cap track assembly upon deflection, the cap track assembly comprising:

(a) a longitudinal metal track having:

(i) a first end and a second end;

(ii) a top wall, and first and second opposed side walls each depending downwardly from and generally perpendicular to the top wall, each side wall having a top end and a bottom end, and the top wall and side walls defining a substantially U-shaped configuration;

(iii) an angled lip extending outwardly from the bottom end of each of the side walls and extending at an angle with respect to said top wall;

(iv) an end tab at the first end of the track, the end tab depending downwardly from and perpendicular to the top wall of the track;

(v) a plurality of top tabs spaced an equal distance apart along the top wall of the track, each top tab depending downwardly from and perpendicular to the top wall of the track;

(vi) a plurality of longitudinal openings formed within the end tab and top tabs;

(b) a plurality of first attachment means passing through the top wall of the track and adapted to be attached to the top structural member for securing the top wall of the track to the top structural member;

(c) plurality of second attachment means passing through the longitudinal openings of the end tab and top tabs and adapted to be attached to the studs for securing the end tab and top tabs of the track to the studs, while also allowing vertical movement of the studs with respect to the longitudinal openings of the tabs; and, (d) a lightweight gypsum-aggregate plaster fireproofing material extending along the outer side walls of the track and supported on the lip of each of the side walls;

wherein during deflection, the track assembly is adapted to slidably receive within the track the studs and gypsum boards, while maintaining attachment of the track assembly to the top structural member.

21. The track assembly of claim 20 wherein the end tab and the top tabs are off center between the side walls of the track, and wherein the end tab is spaced apart from the top tab closest to the end tab at a distance of 24 inches, and wherein each top tab is spaced apart from next top tab at a distance of 24 inches.

22. A cap track assembly for use in a cyclical design fire resistant wall structure, the cap track assembly adapted to be attached to an inclined top structural member and the cap track assembly adapted to have a plurality of studs and a plurality of gypsum boards that move vertically upwardly and downwardly within the cap track assembly upon deflection, and the cap track assembly adapted to be installed between said top structural member and a bottom structural member, the cap track assembly comprising:

(a) a longitudinal metal track having:

(i) a first end and a second end;

(ii) a top wall, and first and second opposed side walls each depending downwardly from and generally perpendicular to the top wall, each side wall having a top end and a bottom end, and the top wall and side walls defining a substantially U-shaped configuration;

(iii) an angled lip extending outwardly from the bottom end of each of the side walls and extending at an angle with respect to said top wall;

(iv) an end tab at the first end of the track, the end tab depending downwardly from and perpendicular to the top wall of the track;

(v) a plurality of top tabs spaced an equal distance apart along the top wall of the track, each top tab depending downwardly from and perpendicular to the top wall of the track;

(vi) a plurality of longitudinal openings formed within the end tab and top tabs;

(b) a plurality of first attachment means passing through the top wall of the track and adapted to be attached to the top structural member for securing the top wall of the track to the top structural member;

(c) a plurality of second attachment means passing through the longitudinal openings of the end tab and top tabs and adapted to be attached to the studs for securing the end tab and top tabs of the track to the studs, while also allowing vertical movement of the studs with respect to the longitudinal openings of the tabs; and, (d) a lightweight gypsum-aggregate plaster fireproofing material extending along the outer side walls of the track and supported on the lip of each of the side walls;

wherein during deflection, the track assembly is adapted to slidably receive within the track the studs and gypsum boards, while maintaining attachment of the track assembly to the top structural member.

23. The cap track assembly of claim 22 wherein the spacing of the end tab and the top tabs of the track are adapted to correspond to spacing of the studs along the bottom structural member.

24. A cap track assembly for use in a cyclical design fire resistant wall structure, wherein the wall structure is curved, the cap track assembly adapted to be attached to a top structural member, and the cap track assembly adapted to have a plurality of studs and a plurality of gypsum boards that move vertically upwardly and downwardly within the cap track assembly upon deflection, the cap track assembly comprising:

(a) a curved metal track having:

(i) a first end and a second end;

(ii) a top wall, and first and second side walls each depending downwardly from and generally perpendicular to the top wall, each side wall having a top end and a bottom end;

(iii) an angled lip extending outwardly from the bottom end of each of the side walls and extending at an angle with respect to said top wall;

(iv) a plurality of metal tabs being bent at a 90 degree angle, each tab having a top portion and a side portion, wherein the top portion of each tab has a plurality of apertures for attachment of the top portion of the tab to the top wall of the track, and wherein the side portion of each tab has a plurality of longitudinal openings for attachment of the side portion of the tab to each stud;

(b) a plurality of first attachment means passing through the apertures in the top portion of the tab, passing into the top wall of the track and adapted to pass into the top structural member for securing the track to the top structural member; (c) a plurality of second attachment means passing through the longitudinal openings in the side portion of the tab, and adapted to pass into the stud for securing the tab to the studs, while also allowing vertical movement of the stud with respect to the longitudinal openings of he tab; and, (d) a lightweight gypsum-aggregate plaster fireproofing material extending along the outer side walls of the track and supported on the lip of each of the side walls;

wherein during deflection, the track assembly is adapted to slidably receive within the track the studs and gypsum boards, while maintaining attachment of the track assembly to the top structural member.

25. A method of installing a track assembly in a cyclical design fire resistant wall structure comprising:

providing the track assembly of claim 1;

mounting the top wall of the track assembly to a top structural member via a first attachment means;

positioning a plurality of vertically extending studs between a bottom structural member and the top structural member wherein the upper portions of the studs are in alignment with the end tab and top tabs of the track and wherein the upper portions of the studs are positioned within the track;

attaching the studs to the end tab and top tabs of the track with a second attachment means bypassing the second attachment means through the longitudinal openings of the end tab and top tabs and into the studs, so as to allow vertical movement upwardly and downwardly along the longitudinal openings; and, installing a plurality of gypsum wallboards on each side of the studs so that the tops of the gypsum wallboards are within the track and move vertically upwardly and downwardly within the track upon deflection and move vertically upwardly and downwardly within the track upon deflection.

* * * * *